US006524142B2

(12) United States Patent
Heimueller

(10) Patent No.: US 6,524,142 B2
(45) Date of Patent: Feb. 25, 2003

(54) UNITARY CONTACT SPRING

(75) Inventor: Hans Jost Heimueller, Dudenhofen (DE)

(73) Assignee: Tyco Electronics AMP GmbH (DE)

( * ) Notice: Subject to any disclaimer, the term of this patent is extended or adjusted under 35 U.S.C. 154(b) by 0 days.

(21) Appl. No.: 09/773,203

(22) Filed: Jan. 31, 2001

(65) Prior Publication Data

US 2002/0065006 A1 May 30, 2002

(30) Foreign Application Priority Data

Jan. 31, 2000 (EP) ..... 00101877

(51) Int. Cl.[7] ..... H01R 11/22
(52) U.S. Cl. ..... 439/852; 439/843
(58) Field of Search ..... 439/852, 851–857, 439/843

(56) References Cited

U.S. PATENT DOCUMENTS

| | | | | | |
|---|---|---|---|---|---|
| 4,540,233 | A | * | 9/1985 | Saijo et al. | 439/834 |
| 4,564,259 | A | * | 1/1986 | Vandame | 439/852 |
| 4,696,530 | A | * | 9/1987 | Vandame | 439/866 |
| 4,834,681 | A | | 5/1989 | Chaillot | 439/856 |
| 5,540,603 | A | * | 7/1996 | Fujiwara | 439/851 |
| 5,562,501 | A | * | 10/1996 | Kinoshita et al. | 439/852 |
| 5,702,272 | A | * | 12/1997 | Machida | 439/843 |
| 5,941,741 | A | * | 8/1999 | Dobbelaere et al. | 439/852 |
| 6,042,433 | A | * | 3/2000 | Chen | 439/852 |
| 6,305,993 | B1 | * | 10/2001 | Heimueller | 439/852 |

FOREIGN PATENT DOCUMENTS

| | | |
|---|---|---|
| DE | 19704311 A1 | 6/1998 |
| DE | 198 26 828 A1 | 1/2000 |
| EP | 0 633 592 A1 | 1/1995 |
| FR | 2 769 414 A | 4/1999 |
| WO | WO 99/41807 | 8/1999 |

OTHER PUBLICATIONS

European Search Report, Application No. EP 01 30 0888.

* cited by examiner

*Primary Examiner*—Tho D. Ta
*Assistant Examiner*—L. Tsukerman

(57) ABSTRACT

A unitary contact with a box-like contact part, in which two spring legs are oppositely arranged that extend to respective free ends in the direction of the mating face of the contact spring where one of the spring legs is formed by a reverse inward bend and the other spring leg is formed through separation from an opposite wall.

18 Claims, 3 Drawing Sheets

UNITARY CONTACT SPRING

BACKGROUND OF THE INVENTION

The invention relates to a unitary contact spring comprising a box-like contact part and two oppositely arranged spring legs extending to free ends in the direction of a mating face of the contact spring.

DESCRIPTION OF THE PRIOR ART

A contact spring of this type is known, for example, from U.S. Pat. No. 4,834,681.

As can be seen from FIGS. 1 and 2 of this patent, the spring legs in the layout are attached laterally along the longitudinal axis of the contact spring and are folded inwards. The spring legs are therefore arranged on the inside of the sidewalls. The top wall, as a result of this folding technique, is divided in the middle and formed as a double wall.

Contact springs are needed in large quantities for use in industry as well as in the automotive field. It is therefore important to be able to manufacture a contact spring with controlled bending operations allowing a high number of strokes and requiring a minimum of consumption of material. The cost of the material for the contact springs of the prior art amounts to about 20% of the manufacturing costs.

The contact spring known from U.S. Pat. No. 4,834,681 has the disadvantage that, as a result of the double wall construction of the top wall as well as the lateral attachment of the spring legs in the layout, a high consumption of material is entailed. Furthermore the split top wall must be separately connected.

A further unitary contact spring having spring legs pointing towards the mating face is known from DE 19704311 A1. However, the spring legs of this contact spring are arranged side-by-side and not opposite one another.

As shown in FIG. 4A of DE19704311 A1, the spring legs are also laterally attached in the layout, resulting again in a high consumption of material. A layout which saves some material is shown in FIG. 1, where the spring legs are attached laterally and slightly obliquely to the longitudinal axis of the contact.

SUMMARY OF THE INVENTION

It is therefore an object of the invention to provide a contact spring of the type set out above which, despite well-controlled bending operations allowing a high number of strokes, minimizes the consumption of material.

It is further required that, even at the end of its service life, the contact force does not fall below 2 Newton and that the contact spring, as a whole, is robust.

According to the invention this object is obtained in that one of the spring legs is formed by inward bending over 180° and the other spring leg by separation out of the opposite wall.

This method of forming spring legs results in a very narrow layout per contact. The spring leg which is bent inwards over 180° is preferably attached in the layout to the extension of the wall on the inner side of which it is attached in its unbent state.

Compared with a lateral attachment in the layout, this configuration has the advantage that the layouts of the individual contacts can be arranged more closely, thereby achieving a higher utilization factor when stamping from the continuous strip of material.

The material utilization can be further increased by attaching the spring leg, which is to be bent inwardly over 180°, obliquely to the longitudinal axis of the wall on the inner side of which it is arranged in its bent state.

Further advantageous embodiments of the contact spring are disclosed in the dependent claims.

DETAILED DESCRIPTION OF THE PREFERRED EMBODIMENT

Figure 1:
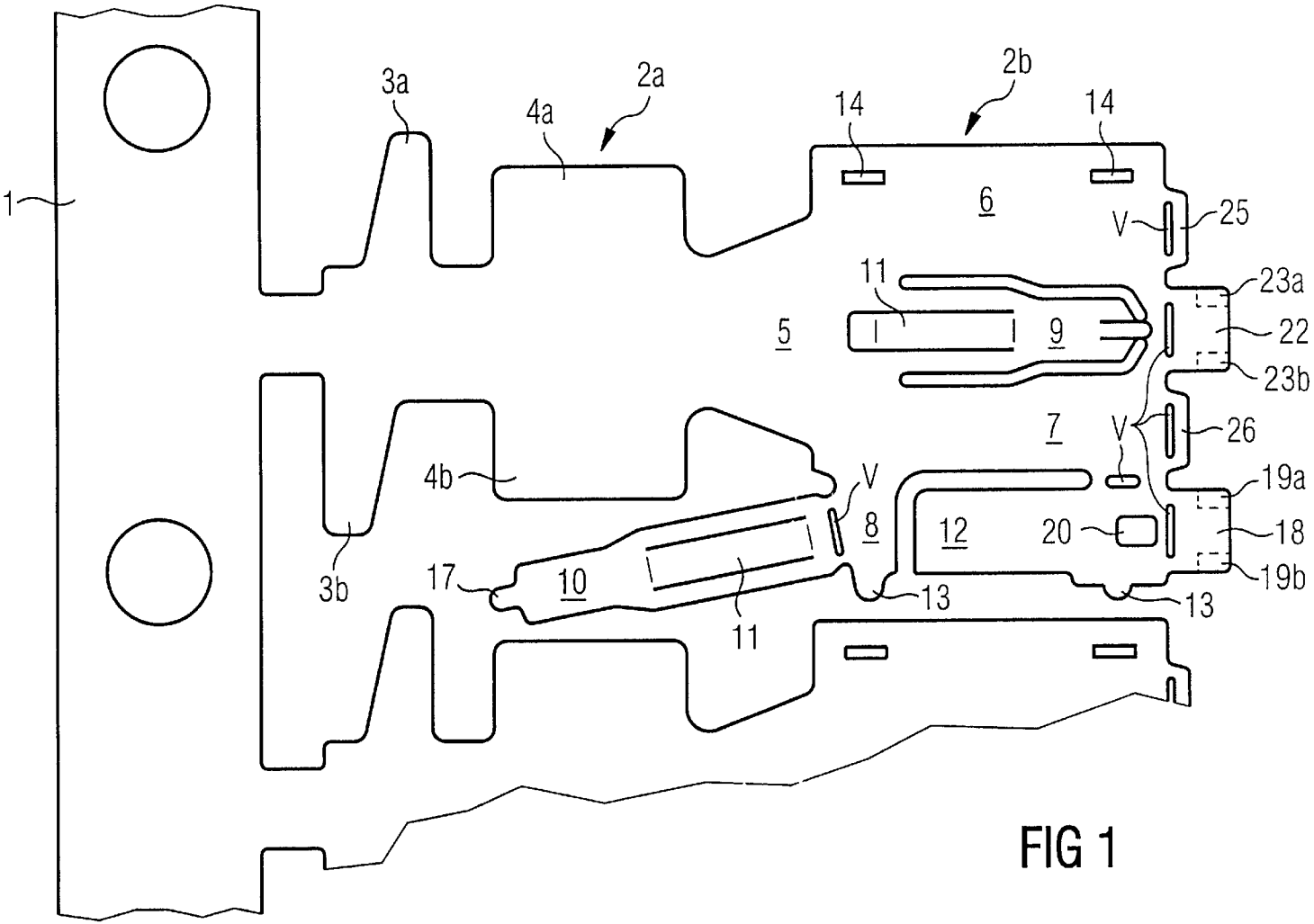
FIG. 1 shows part of a continuous strip with the stamped layout of one contact as well as a partially represented layout of its adjacent contact.

FIG. 1 shows a strip 1, onto which layouts for the contact spring according to the invention are attached. A complete layout of one contact spring as well as the layout in part of its adjacent contact spring is shown. The contact spring essentially consists of a terminal part 2*a* and a contact part 2*b*. In the embodiment shown, the terminal part 2*a* is formed as a crimp terminal with crimp tabs 3*a* and 3*b* as well as 4*a* and 4*b*.

In the layout, the contact part 2*b* comprises a bottom wall 5, laterally thereto side walls 6 and 7 and on the underside, top wall 8. A spring leg 9 is separated out of the bottom wall 5, such that its free end points towards the mating face of the contact part. A further spring leg 10 is attached slightly obliquely to the longitudinal axis of the contact to the top wall 8 in the direction of the terminal part 2*a*.

Both spring legs 9 and 10 are provided with stampings or through-cracks 11. These serve to increase the stiffness of the spring legs and, in the case of spring leg 10, are arranged centrally inside the spring leg. In the case of spring leg 9, the stamping 11 from the bottom wall 5 into the leg 9 is also arranged centrally to the spring leg 9. A latching hook 12 is separated out of the top wall 8 by means of an L-shaped separation cut.

During the manufacture of the contact spring, after the formation of all the separation cuts, the stampings 11 are formed in the spring leg 10 and the latter is subsequently folded over by 180° onto the top wall 8 and aligned parallel to the longitudinal direction of the contact spring.

In the next step, the crimp tabs 3*a*, 3*b* as well as 4*a* and 4*b*, in addition to side walls 6 and 7 are bent upwards over 90° from the bottom wall 5. The stamping 11 is subsequently formed in spring leg 9. Finally the top wall 8 with the spring leg 10 lying on its inner side is bent over 90° to close the box-like contact part. A connecting tab 13 is formed in the top wall 8 and the latching hook 12, which are inserted into the side wall 6 through corresponding apertures 14.

Figure 2:
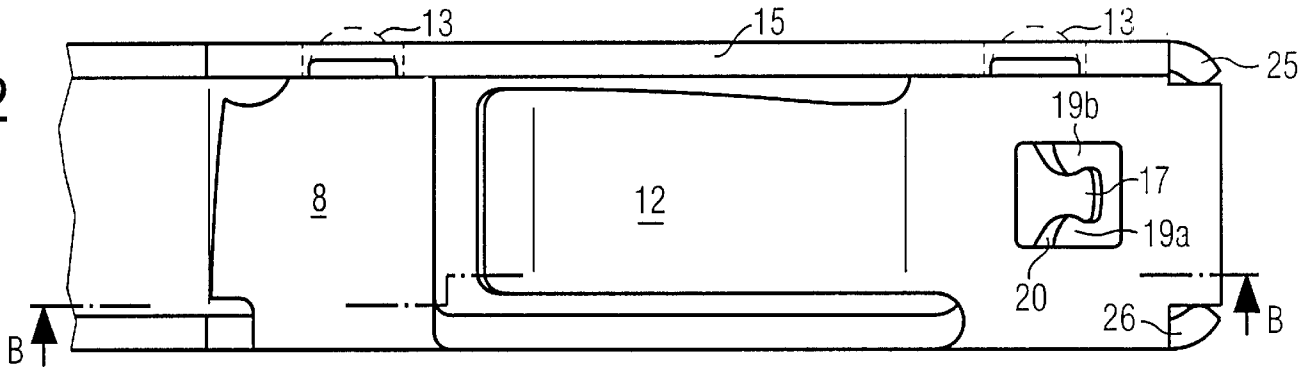
FIG. 2 shows a top view of the box-like contact part of the unitary contact spring.

FIG. 2 shows a top view of the box-like contact part. In this view, the connecting tabs 13 are already inserted into apertures 14 and slightly protrude on the outside beyond the side walls 6.

As can be seen from FIG. 5, which shows section AA of FIG. 3, the protruding connecting tabs 13 are subsequently pressed flat against the outside of side wall 6. As can be seen from the dashed lines in FIG. 2, the connecting tabs 13 comprise a lower chamfered edge in the protruding region.

Likewise, a chamfered edge 16 is formed in the region of the apertures 16 on the part of the side wall 6, which protrudes beyond the top wall 8 and which forms at the same time a continuous polarization 15. The closing of the box during the bending operation is facilitated by the chamfered edge 16 as well as by the chamfered edges on the connecting tabs 13.

Figure 3:
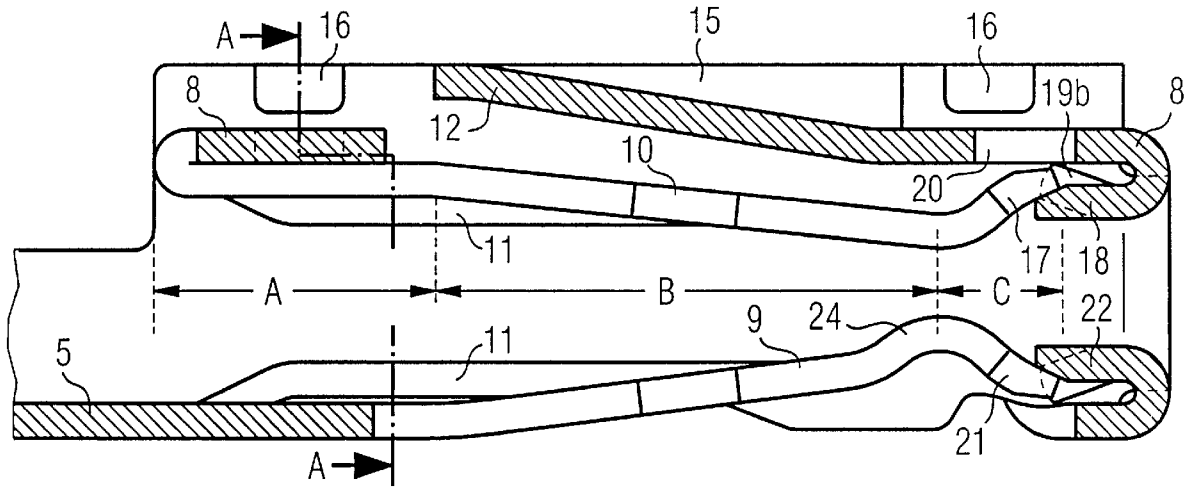
FIG. 3 shows section BB of FIG. 2.
Figure 4:
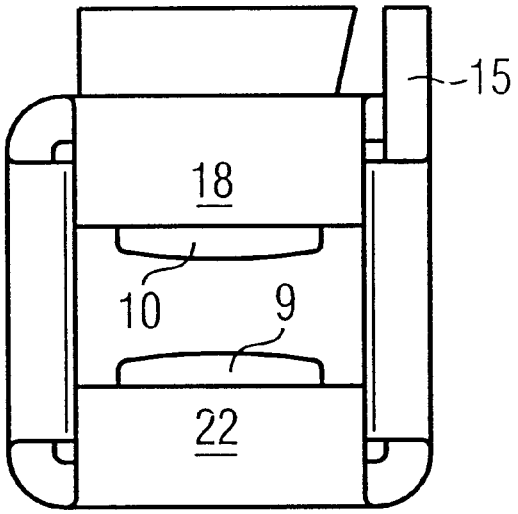
FIG. 4 shows a box-like contact part as seen from the mating face.

FIG. 3 shows section BB of FIG. 2. The latching hook 12 is bent upwards out of the top wall 8. The upper spring leg 10 is bent over inwardly in a first region A over 180° parallel to the top wall 8 and in a second region B is bent slightly inwardly in the direction of the opposite spring leg 9. In the third region C, the spring leg 10 is again bent upwards in order to facilitate the introduction of a contact blade (not shown). The free end of the spring leg 10 is formed as a point 17.

In order to prevent insertion of the contact blade behind spring leg 10, a tab 18 is provided on the frontal side of the top wall 8, which is bent over, over 180°, to receive the point 17 of the spring leg 10 between itself and the top wall 8. Side parts 19*a* and 19*b* are formed on tab 18 and are bent over by more than 180° and thereby also guide point 17 laterally.

In order to enable the displacement of the spring leg 10 during the insertion of a contact blade, a window 20 is provided in the top wall 8, into which point 17 can deflect. The spring leg 9, which has been separated out from the bottom wall 5, also comprises a point 21 which, as shown in FIG. 1, is formed in the bottom wall 5 by means of a waste-free separation cut. The point 21 is also fixed via a tab 22 bent over inwardly over 180° between tab 22 and bottom wall 5, whereby side parts 23*a* and 23*b*, which are bent over inwardly by more than 180° also assure a lateral fixing. The spring leg 9 is also bent inwards, in the region opposite to section B of spring leg 10, and comprises at its free end, a bulge 24 pointing in the direction of the opposite spring leg 10 for making contact with the contact blade to be inserted. The stampings or the through-cracks 11 extend, in the case of spring leg 10, from section A to approximately the middle of section B and, in the case of spring leg 9, from the bottom wall 5 to approximately the middle of spring leg 9.

Figure 5:
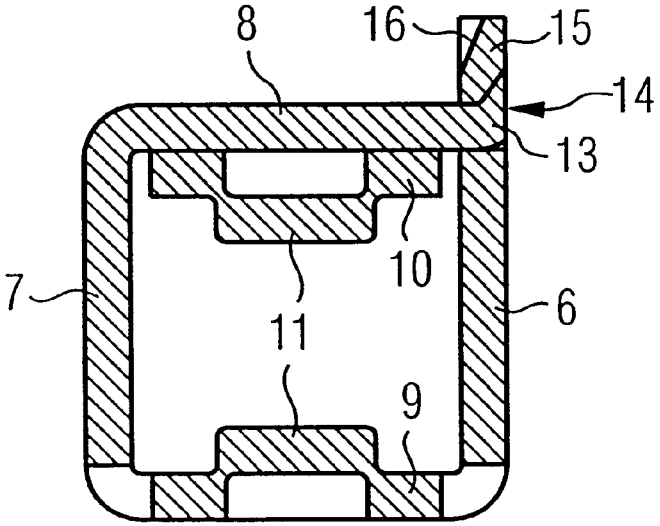
FIG. 5 shows section AA of FIG. 3.

As can be seen from FIG. 5, the size of the through-crack 11 at the location of section AA is approximately equal to the thickness of the material of the spring leg 9 or 10. The stamping or through-crack 11 on spring leg 10 is somewhat wider than on the spring leg 9, whereby a higher contact force is obtained. In order to facilitate the frontal insertion of the contact blade, the side walls also comprise guide tabs 25, 26 which are slightly bent inwardly (see FIG. 2) for forming a guide funnel.

In order to facilitate the bending processes, prestampings V are foreseen between guide tabs 25, 26 (as well as between tabs 18, 22) and adjacent walls as well as between the top wall 8 and the side wall 7 as well as between the spring leg 10 and the top wall 8.

The invention is not limited to the embodiment shown. For instance, the terminal part 2*a* can also be formed as an IDC or as a flexible terminal. It is furthermore also possible to connect the top walls 8 with the side wall 6 by laser soldering instead of pressing the tabs 13 into apertures 14.

I claim:

1. A contact spring comprising a box-like contact part having first and second spring legs oppositely arranged that extend to free ends in the direction of a mating face of the contact spring, characterized in that the first spring leg includes a reverse inward bending and the second spring leg is formed by separation out of a second wall where the first spring leg extends from a first wall end is bent over 180°; and tabs are bent inwards over 180° are provided on the first and second walls on which the spring legs are arranged, the tabs capture the free ends of the spring legs between the tabs and the respective first and second walls.

2. The contact spring according to claim 1, characterized in that the spring leg that includes the reverse inward bend is attached laterally at an inner side of the first wall which it is arranged.

3. The contact spring according to claim 1, characterized in that the spring leg that includes the reverse inwards bend is arranged in the layout obliquely to the longitudinal axis of the contact spring.

4. The contact spring according to claim 1, characterized in that the spring legs are provided with stampings for increasing their resilient force.

5. The contact spring according to claim 4, characterized in that the stampings are formed on the spring legs in the direction of the interior of the box-like contact part.

6. The contact spring according to claim 4, characterized in that a first region of the spring leg that includes the reverse inward bend is arranged parallel to the first wall and in that an adjacent second region thereof is slightly bent towards the opposite spring leg, and in that the stampings extend from the first region into the second region.

7. The contact spring according to claim 4, characterized in that the spring leg which has been separated out from the second wall is slightly bent in the direction of the opposite spring leg and in that the stampings of the second wall extend into the spring leg.

8. The contact spring according to claim 7, characterized in that the stampings are arranged centrally relative to the longitudinal axes of the spring legs.

9. The contact spring according to claim 8, characterized in that the spring leg which has been separated out from the wall comprises a bulge pointing in the direction of the opposite spring leg.

10. The contact spring according to claim 1, characterized in that a window is arranged in the wall opposite to the spring leg which has the reverse inward bend in the region of its free end, such that this free end is displaced during insertion of a contact.

11. The contact spring according to claim 10, characterized in that the free end of the spring leg which has been stamped out of the wall is formed via a separation cut.

12. The contact spring according to claim 11, characterized in that the free ends of the first and second spring legs are formed with a point.

13. The contact spring according to claim 12, characterized in that bent-over tabs are bent over laterally of the point of the spring legs to laterally guide the points of the spring legs.

14. The contact spring according to claim 13, characterized in that guide tabs are arranged at the mating face on walls other than those on which spring legs are formed in order to form a guide funnel.

15. The contact spring according to claim 14, characterized in that the wall with the spring leg which includes the reverse inward bend includes in its central part a latching hook formed via separation cuts and bent outwardly.

16. The contact spring according to claim 15, characterized in that one wall protrudes sideways beyond the box-like outer perimeter of the contact part and in that the protruding section forms a polarization.

17. The contact spring according to claim 16, characterized in that the wall with the spring leg which includes the reverse inward bend includes at least two connecting tabs which, after bending of the box-like form, are inserted through corresponding apertures in the wall with the polarization and are subsequently pressed together with the outside of the wall with the polarization.

18. The contact spring according to claim 17, characterized in that the connecting tabs are chamfered on their underside and in that the polarization in the region of the apertures is provided with a chamfered edge for the connecting tabs.

* * * * *